US005307958A

United States Patent [19]

Burrows

[11] Patent Number: 5,307,958

[45] Date of Patent: May 3, 1994

[54] BOTTLED WATER STATION WITH REMOVABLE RESERVOIR

[75] Inventor: Bruce D. Burrows, Valencia, Calif.

[73] Assignee: Ebtech, Inc., Columbus, Ohio

[21] Appl. No.: 64,923

[22] Filed: May 24, 1993

Related U.S. Application Data

[63] Continuation-in-part of Ser. No. 955,330, Oct. 1, 1992, Pat. No. 5,246,141, which is a continuation-in-part of Ser. No. 688,861, Apr. 22, 1991, Pat. No. 5,192,004.

[51] Int. Cl.[5] ..... B67D 5/62

[52] U.S. Cl. ..... 222/146.1; 222/146.6; 222/185; 62/390

[58] Field of Search ..... 222/146.1, 146.2, 146.5, 222/146.6, 185; 62/390, 395

[56] References Cited

U.S. PATENT DOCUMENTS

| | | | |
|---|---|---|---|
| 1,809,958 | 6/1931 | Wright | 62/395 X |
| 2,291,256 | 7/1942 | Rehrig et al. | 62/395 |
| 2,557,252 | 6/1951 | Bannister et al. | 62/395 |
| 2,681,549 | 6/1954 | Maxwell | 62/395 X |
| 3,018,915 | 1/1962 | Larson | 62/395 X |
| 3,811,294 | 5/1974 | Taylor | 62/390 |
| 4,629,096 | 12/1986 | Schroer et al. | 222/146.6 |

*Primary Examiner*—Andres Kashnikow
*Assistant Examiner*—Lesley D. Morris
*Attorney, Agent, or Firm*—Kelly Bauersfeld & Lowry

[57] ABSTRACT

An improved bottled water station includes a removable reservoir for drop-in installation into and lift-out removal from a station housing. The reservoir is constructed from a lightweight molded plastic or the like to have an open upper end for receiving and supporting an inverted water bottle, and an internal baffle plate which subdivides the interior of the reservoir into upper and lower chambers. A ratchet nut is carried at the underside of the reservoir for slide-fit engagement with a mating ratchet member when the reservoir is drop-in installed into the station housing, wherein the ratchet member releasibly retains the reservoir in intimate seated contact with a chiller plate unit for chilling water within the lower reservoir chamber. Separate faucet valves are assembled with the reservoir, to extend through openings in a front wall of the station housing, for individual dispensing of chilled water from the lower reservoir chamber and room temperature water from the upper reservoir chamber. If desired, a hot water fitting can be provided for delivering water from the reservoir to a hot water tank, and a separate faucet valve provided for dispensing hot water.

21 Claims, 4 Drawing Sheets

FIG. 1
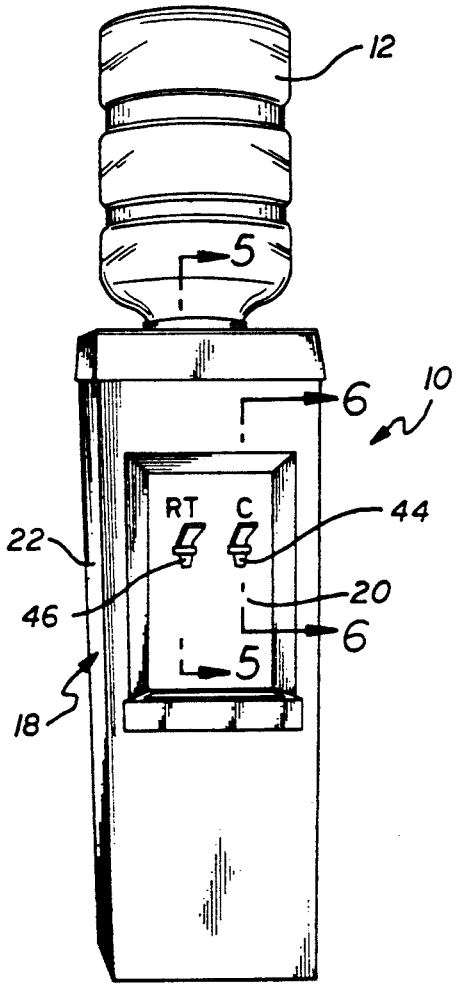
FIG. 2
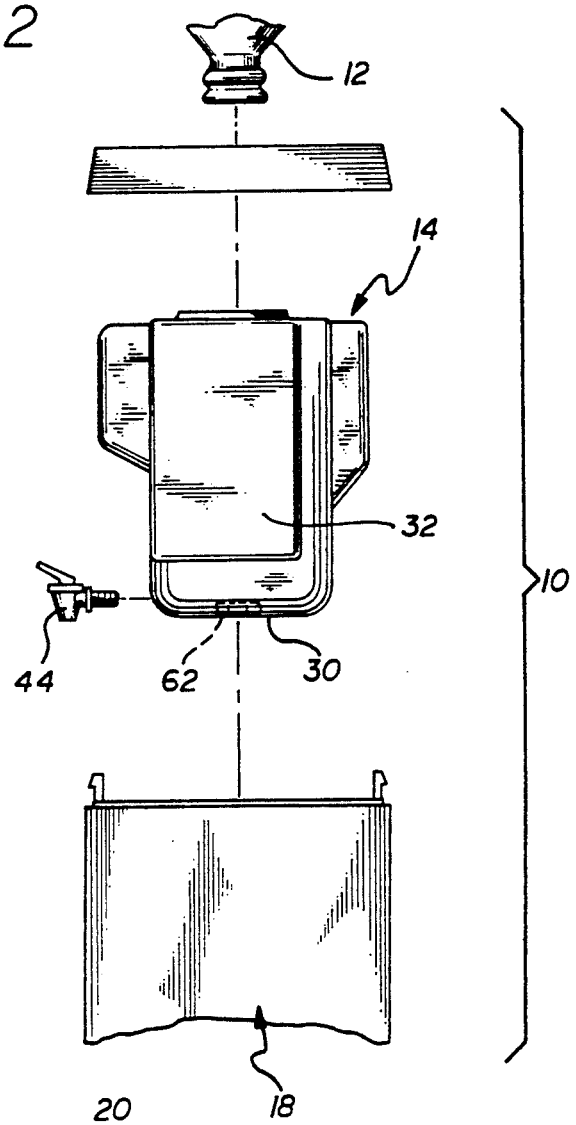
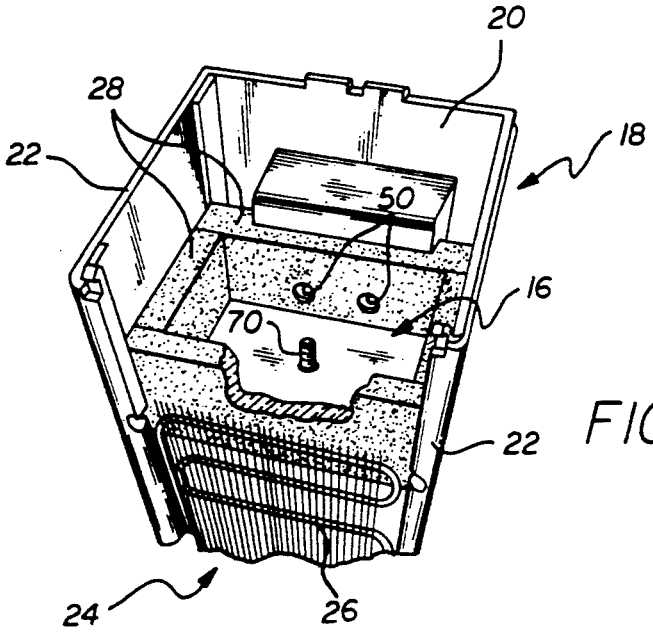
FIG. 3

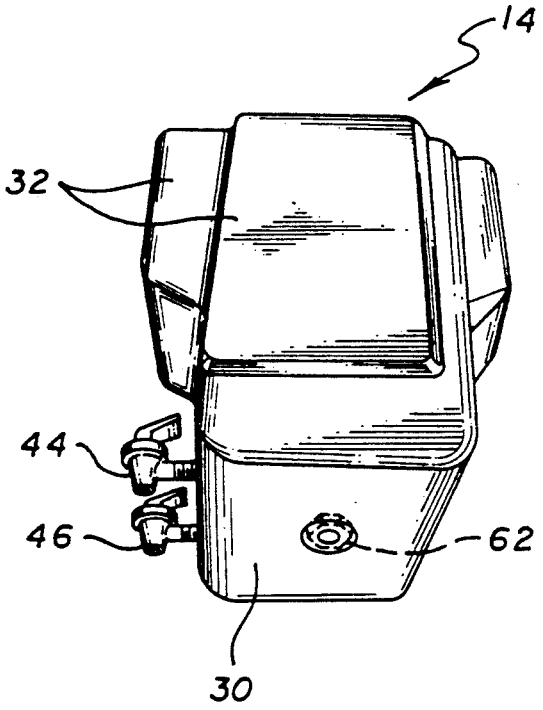
FIG. 4
FIG. 7
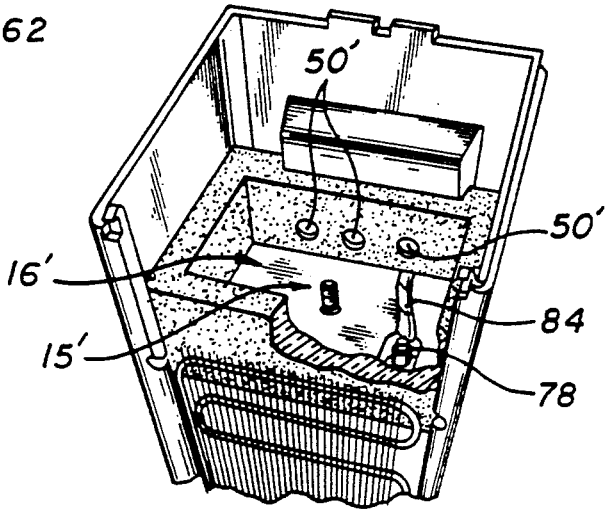
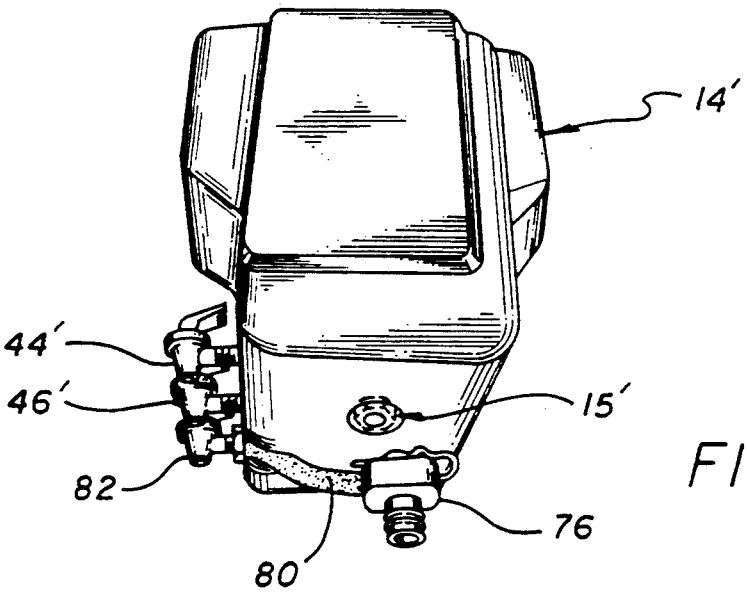
FIG. 8

BOTTLED WATER STATION WITH REMOVABLE RESERVOIR

BACKGROUND OF THE INVENTION

This a continuation-in-part of copending U.S. patent application Ser. No. 07/955,330, filed Oct. 1, 1992, now U.S. Pat. No. 5,246,141, issued Sep. 21, 1993, which is in turn a continuation-in-part of copending U.S. patent application Ser. No. 07/688,861, filed Apr. 22, 1991, now U.S. Pat. No. 5,192,004, issued Mar. 9, 1993.

This invention relates to improvements in bottled water dispenser stations of the type adapted to receive and support a water bottle in an inverted position, and to selectively dispense water therefrom. More specifically, this invention relates to an improved bottled water station having a removable reservoir designed for drop-in installation into a station housing, wherein the reservoir and station housing include means for retaining the reservoir in intimate seated contact with a chiller plate unit mounted within the station housing.

Bottled water dispenser stations are well-known in the art for containing a supply of relatively purified water in a convenient manner and location ready for substantially immediate dispensing and use. Such bottled water stations commonly include an upwardly open reservoir mounted on a station housing and adapted to receive and support an inverted water bottle of typically three to five gallon capacity. Water within the inverted bottle flows downwardly into the station reservoir for selective dispensing therefrom through a faucet valve on the front of the station housing. Such bottled water stations are widely used to provide a clean and safe source of water for drinking and cooking, especially in areas where the local water supply is suspected to contained undesired levels of contaminants.

In bottled water stations of the above-described type, the water bottles are normally provided by a vendor in a clean and preferably sterile condition with an appropriate sealed cap to prevent contamination of the water contained therein. When an inverted bottle on a station housing reaches an empty condition, the empty bottle can be lifted quickly and easily from the station housing and replaced by a filled bottled having the sealing cap removed therefrom. The empty bottle can then be returned to the bottled water vendor for cleaning and refilling.

Although bottled water stations of this type utilize a sequence of water bottles which have been individually sanitized, the water reservoir within the station housing has not been subjected to periodic cleaning or replacement. In this regard, the housing reservoir typically comprises a metal or ceramic tank mounted within the station housing in association with a refrigeration system having a chiller coil for maintaining water within the reservoir in a chilled condition. In other station housing designs, the reservoir is subdivided into distinct chambers, one of which is associated with a refrigeration system, to provide separately dispensed supplies of chilled water and room temperature water. Still further, in other designs, an auxiliary reservoir is provided in association with suitable heating elements to produce a heated water supply. Unfortunately, the integration of the station housing reservoir with associated chilling and/or heating systems has generally precluded easy access to or removal of the reservoir for cleaning purposes. Instead, the housing reservoir has typically been used for prolonged time periods without cleaning, thus creating the potential for undesired growth of harmful bacteria and other organisms. Reservoir cleaning has generally been accomplished by taking the station out of service and returning the station to a centralized facility for cleaning purposes.

In one proposed construction for a bottled water station, a removable reservoir container has been suggested for drop-in placement and lift-out removal with respect to a supporting chiller plate mounted within a station housing. See, for example, U.S. Pat. No. 4,629,096. While this configuration beneficially facilitates removal of the reservoir container for cleaning purposes, significant problems have been encountered with respect to formation of condensation and/or frost in the space between the removable reservoir container and the chiller plate. As a result, such bottled water stations have encountered significant drip problems requiring inclusion of a drip tray, and often resulting in undesirable water puddling on the floor beneath the station housing. Condensate dripping onto carpeted or tiled floor areas in a typical in-home or office environment is, of course, extremely undesirable.

The present invention overcomes the problems and disadvantages of the prior art by providing an improved bottled water station having a modular water reservoir adapted for drop-in installation into and corresponding slide-out removal from a station housing. The improved bottled water station includes interlocking ratchet means coacting between the removable reservoir and a station chiller plate unit for retaining the reservoir and chiller plate unit in intimate seated contact with each other, thereby providing a broad surface contact area for efficient thermal exchange while minimizing or eliminating generation of condensation or frost.

SUMMARY OF THE INVENTION

In accordance with the invention, an improved bottled water station includes a removable reservoir for drop-in, slide-fit installation into a station housing, and for receiving and supporting a water supply bottle in an inverted position. The reservoir may be constructed from a lightweight molded plastic or the like, and has a slide-fit lock member mounted at the underside thereof. The lock member is adapted to engage an upstanding mating lock member mounted within the station housing, when the reservoir is slide-fit installed into the station housing, with said interengaged lock members retaining the reservoir in intimate seated contact upon a chiller plate unit forming a portion of a station housing refrigeration system. One or more faucet valves are adapted for assembly with the installed reservoir, and are positioned at the front of the station housing for use in dispensing water from the reservoir.

In one preferred form of the invention, the slide-fit lock member on the reservoir comprises a slip nut of a type adapted for axial push-on engagement with a bolt protruding upwardly from the chiller plate unit. The reservoir is dropped into the station housing and pressed downwardly to seat the reservoir underside in intimate and broad surface area contact with the chiller plate unit. The slide-on nut and bolt cooperate to retain the reservoir seated firmly upon the chiller plate unit.

The chiller plate unit is mounted on a horizontal platform means within the station housing, preferably in association with insulation panels defining an upwardly open box for close-fitting, slide-in reception of the reservoir. The chiller plate unit comprises a generally flat or planar structure having a hollow interior with a chiller coil of a conventional refrigeration system received therein. The residual volume of the interior of the chiller plate unit is occupied by a heat conductive fluid selected for efficient thermal exchange between the chiller coil and an upper support plate upon which the reservoir is seated. One preferred heat transfer fluid comprises water or a water-based fluid adapted to undergo state change from liquid to solid each time the refrigeration system cycles on.

When the reservoir is installed into the station housing, faucet fittings on a front wall of the reservoir are disposed in substantial alignment with faucet ports formed in a front wall of the station housing and associated insulation panels. Individual faucet valves are assembled with the reservoir to extend through the faucet ports, as by threaded engagement with said faucet fittings.

In one form, a perforated baffle plate is installed within the interior of the reservoir to subdivide reservoir interior into upper and lower chambers. The chiller plate unit chills water within the lower reservoir chamber, and the insulation panels within the station housing surround the lower portion of the reservoir in close-fitting relation therewith. One faucet valve is provided to dispense chilled water from the lower chamber, and a second faucet valve is provided to dispense water from the upper chamber of the reservoir. If desired, a hot water fitting may also be provided for delivering water from the reservoir to a separate water tank associated with a heating element, and a separate hot water dispense faucet may be provided on the front wall of the station housing for dispensing hot water.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a front perspective view illustrating a bottled water dispenser station adapted for use with a removable reservoir and embodying the novel features of the invention;

FIG. 2 is a fragmented and exploded side elevational view depicting drop-in installation of a reservoir into a station housing;

FIG. 3 is an enlarged rear perspective view of the station housing, with the removable reservoir separated therefrom;

FIG. 4 is an enlarged bottom perspective view depicting the removable reservoir of the present invention;

FIG. 7 is an enlarged rear perspective view similar to FIG. 3, and illustrating a station housing embodying an alternative preferred form of the invention; and FIG. 8 is an enlarged bottom perspective view depicting an alternative preferred form of the removable reservoir, for slide-in installation into the station housing shown in FIG. 7.

DETAILED DESCRIPTION OF THE PREFERRED EMBODIMENTS

Figure 5:
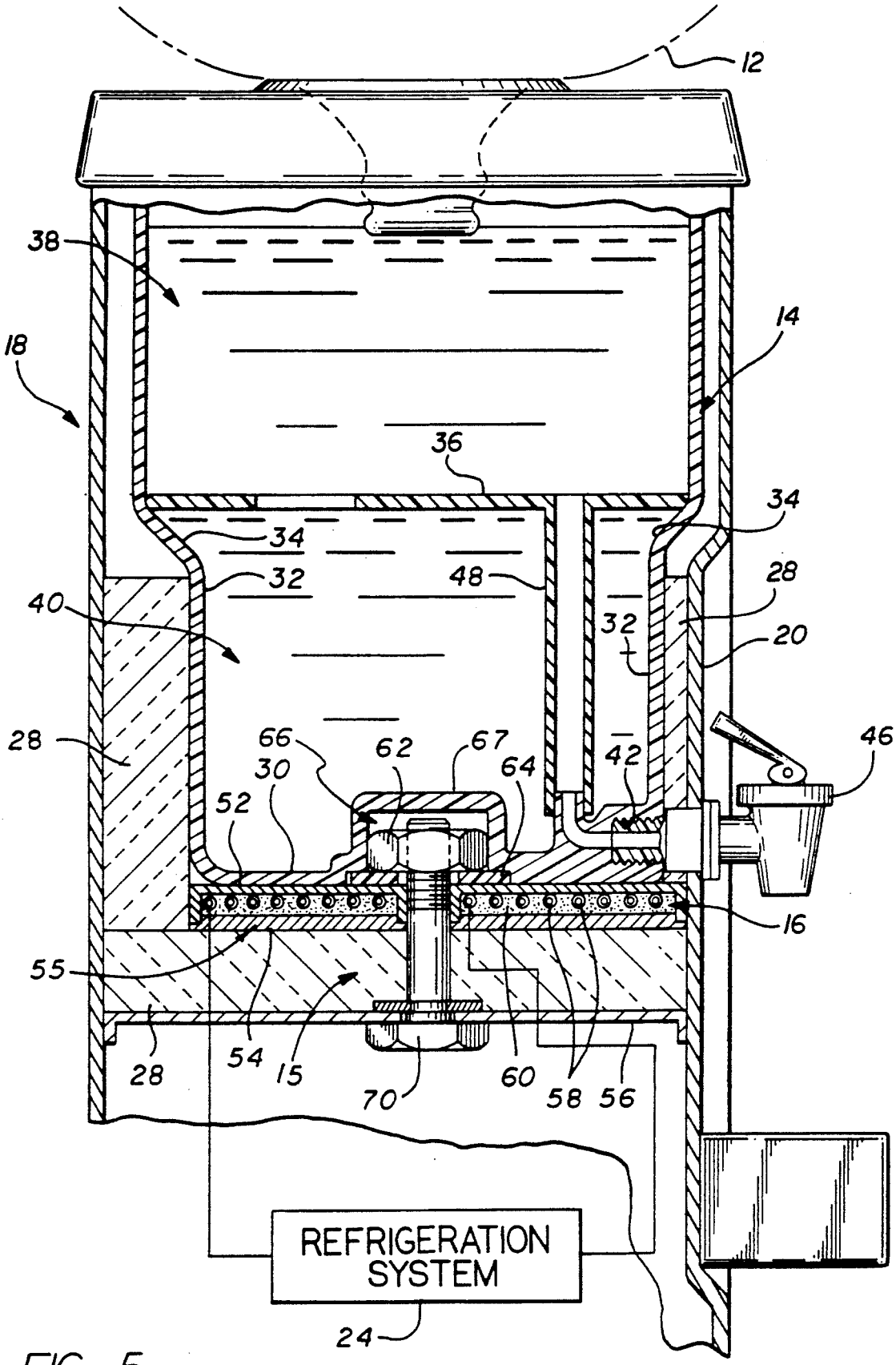
FIG. 5 is an enlarged fragmented and somewhat diagrammatic vertical sectional view taken generally on the line 5—5 of FIG. 1, and illustrating the removable reservoir installed into the station housing.

As shown in the exemplary drawings, a bottled water station referred to generally in FIG. 1 by the reference numeral 10 is provided for receiving and supporting a water bottle 12 containing a supply of relatively purified water for drinking and cooking uses, etc. The bottled water station 10 includes a removable reservoir 14 (FIG. 2) adapted for drop-in installation into and slide-out removal from the bottled water station 10 thereby permitting quick and easily removal of the reservoir 14 for cleaning and/or replacement. The reservoir 14 and bottled water station 10 include interengageable, slide-fit lock means 15 (FIG. 5) for securely retaining the reservoir 14 in intimate seated contact with a chiller plate unit 16.

The illustrative bottled water station 10 has a generally conventional overall size and shape to include an upstanding cabinet or housing 18. This station housing 18, in combination with the removable reservoir 14 to be described in more detail, supports the water bottle 12 in an inverted orientation such that water contained therein will flow downwardly by gravity into the reservoir 14. The chiller plate unit 16 reduces the temperature level of water contained within at least a portion of the reservoir 14 to a chilled and refreshing beverage temperature, typically on the order of about 40°-50° F. The water is adapted for quick and easy dispensing from the reservoir via one or more faucet valves mounted in accessible positions on a front wall 20 of the station housing 18. Importantly, in accordance with the present invention, the removable reservoir is securely yet removably retained in a snug, close-fitting relation with the chiller plate unit 16, thereby providing efficient heat transfer communication between the chiller plate unit 16 and the interior of the reservoir 14, while correspondingly eliminating residual space between these components and accompanying risk of forming frost or condensation on the exterior of the reservoir.

With reference to FIGS. 1-3, the station housing 18 is shown to have an upstanding, generally rectangular configuration to include the front wall 20 joined to a pair of housing side walls 22, and a housing back which has a typically open construction (FIG. 3). A refrigeration system 24 is normally mounted within a lower portion of the housing interior and comprises a conventional compressor (not shown) for circulating a refrigerant through a closed loop cycle including, for example, finned heat transfer tubing 26 mounted across the open back of the housing 18 (FIG. 3). The chiller plate unit 16 is mounted within the housing 18 to extend generally horizontally across the housing interior, at a position spaced below the upper end of the housing. The front and side walls 20, 22 of the station housing 18 cooperate with the chiller plate unit 16 to define an upwardly open cavity at the upper end of the station housing. In general terms, the removable reservoir 14 is designed for drop-in mounting into this cavity. Insulation panels 28 of styrofoam or other suitable insulative material are arranged in an upwardly open and generally rectangular or box-like arrangement within the housing cavity, to extend upwardly from the peripheral edges of the chiller plate unit 16, for purposes of insulating at least a lower portion of the reservoir 14.

The removable reservoir 14 may be constructed conveniently and economically from a lightweight molded plastic or the like, such as polyethylene, with an overall size and shape for relatively snug-fit reception into the housing cavity. In this regard, the reservoir 14 includes a bottom wall 30 shaped for substantial conformance with the uppermost surface of the chiller plate unit 16. In addition, the reservoir defines upstanding side walls 32 adapted for relatively close-fit reception into the housing cavity, in press-fit contact with the insulation panels 28. In the preferred embodiment, as shown in FIG. 5, the reservoir includes an upper portion defined by outwardly extended segments of the side walls 32, thereby defining a peripheral shoulder 34 disposed a short distance above the upper edges of the insulation panels 28, when the reservoir module is installed into the bottled water station. A perforated baffle plate 36 is mounted within the reservoir interior, in a position with marginal edges resting upon the shoulders 34, whereby this baffle plate subdivides the reservoir interior into an upper chamber 38 and a lower chamber 40.

Figure 6:
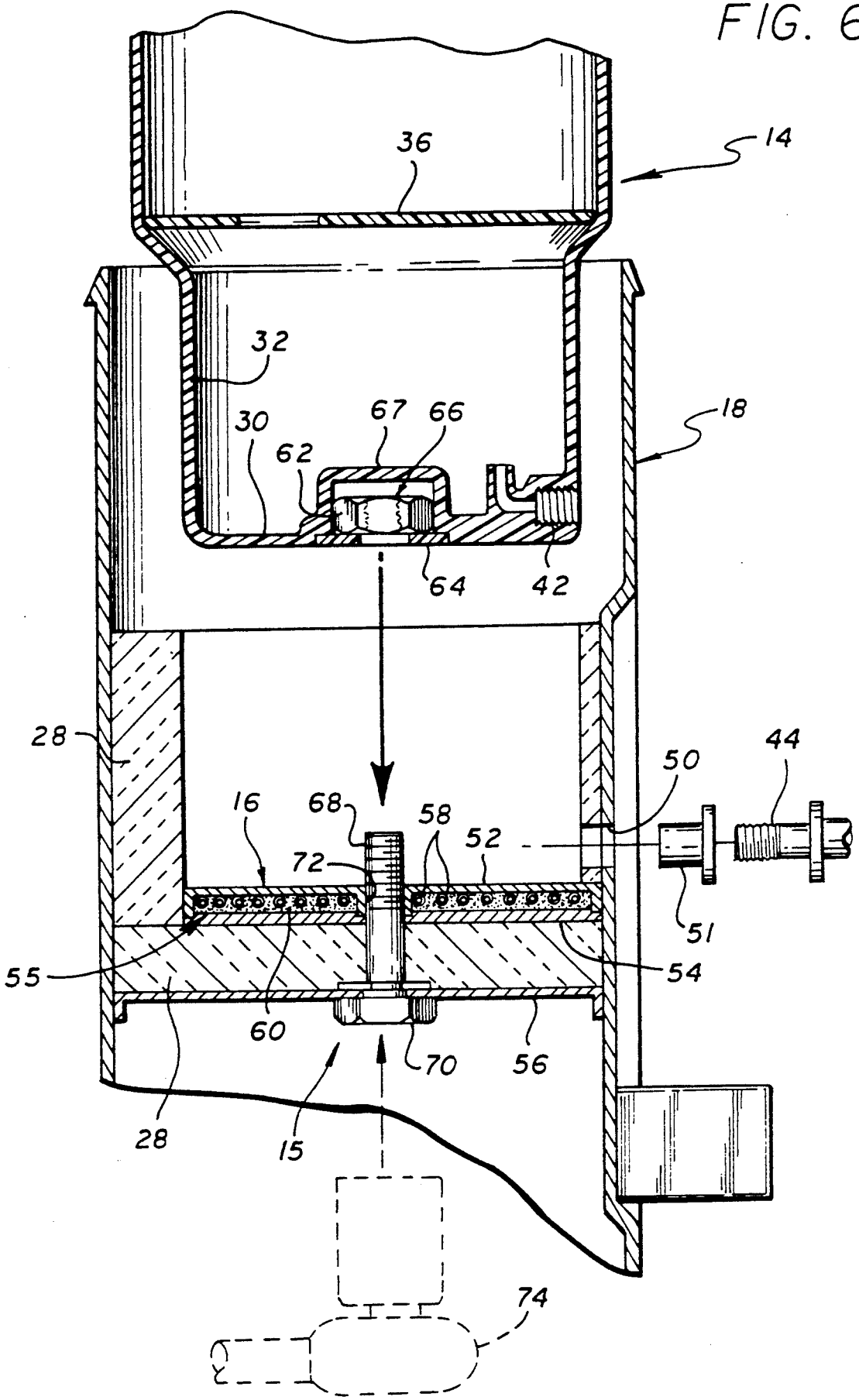
FIG. 6 is an enlarged fragmented vertical sectional view taken generally on the line 6—6 of FIG. 1, and illustrating slide-in installation of the reservoir into the station housing.

One of the reservoir side walls 32 defines a front wall for the reservoir container, and includes at least one threaded faucet fitting 42. In the preferred form, as shown in FIGS. 4–6, a pair of the faucet fittings 42 are provided to accommodate thread-in mounting of a pair of faucet valves 44 and 46. One of the threaded fittings 42 is in direct flow communication with the lower reservoir chamber 40, whereas the other threaded fitting 42 is in flow communication with the upper reservoir chamber 38 via a hollow standpipe 48 projecting downwardly from the baffle plate 36. The faucet valves 44 and 46 are adapted for thread-in mounting with the faucet fittings 42, subsequent to drop-in installation of the reservoir 14 into the station housing. In this regard, when the reservoir is fully seated within the station housing, the threaded fittings 42 are positioned in general alignment with a pair of faucet ports 50 (FIG. 3) formed through the adjacent panel 28 and the front wall 20 of the station housing. A rubber bushing 51 (FIG. 6) conveniently lines the passage of the threaded faucet ends through the ports 50.

The chiller plate unit 16 is shown best in FIGS. 5 and 6, and generally comprises a pair of upper and lower support plates 52 and 54 interconnected to define a hollow, relatively low profile interior chamber 55. The assembled plates 52 and 54, which can be formed economically and conveniently from lightweight molded plastic or the like, are supported in a generally horizontal position on top of an underlying insulation panel 28, which is in turn supported upon a horizontal station platform 56.

A chiller coil 58 is wrapped in spiral fashion within the chamber 55 of the chiller plate unit 16. The chiller coil is provided as part of the refrigeration system 24, and provides a cold source for chilling water within the lower reservoir chamber 40. In accordance with one aspect of the invention, the residual volume of the chamber 55, surrounding the chiller coil 58, is occupied by a heat transfer fluid 60 chosen for relatively efficient heat conductivity, thereby providing a broad surface area of uninterrupted conductive thermal exchange between the coil 58 and the upper support plate 52. This high thermal exchange efficiency permits the use of plastic support plate materials, in combination with the plastic reservoir material, while providing sufficient cooling of the water within the lower reservoir chamber 40. Although a variety of heat exchange fluids may be used, one preferred material comprises a polymeric heat transfer compound marketed by Prestite Division of Inmont Corporation, St. Louis, Miss., under the name Prestite Thermal Mastic.

In another form, a preferred heat transfer fluid comprises water, or a water based fluid adapted to undergo state change from liquid to solid each time the refrigeration system 24 is operated. With a state change fluid, substantial cooling capacity can be stored by the fluid 60, due to heat of fusion phenomena, whereby water in the lower chamber 40 can be chilled rapidly and efficiently despite rapid dispensing draws therefrom and with relatively prolonged time periods between operation of the refrigeration system.

The reservoir lock means 15 comprises a ratchet nut 62 captured by a retaining ring 64 within a downwardly open pocket 66 formed by a cup-shaped central segment 67 on the underside of the reservoir 14. The ratchet nut 62 comprises, in the preferred form, a slide-fit or slip-fit nut for axial press-on engagement with threads 68 on a bolt 70 mounted within the station housing to project upwardly through a central aperture 72 in the chiller plate unit 16. Thus, slide-in installation of the reservoir 14 effectively engages the bolt 70 with the ratchet nut 62, with sufficient axial retention force to retain the bottom wall 30 of the reservoir in intimate seated contact upon the support plate 52 of the chiller plate unit 16. With this arrangement, residual space or volume between the exterior of the reservoir and the chiller plate unit is substantially eliminated, thereby substantially eliminating undesirable condensate formation and resultant dripping attributable thereto.

FIG. 5 illustrates the reservoir 14 in fully seated relation upon the chiller plate unit 16, with the ratchet nut 62 engaged with the bolt 70, whereas FIG. 6 illustrates drop-in installation of the reservoir 14 into the station housing. While a variety of ratchet nut and bolt configurations may be used, preferred constructions are depicted in U.S. Pat. Nos. 5,139,381 and 4,378,187 which are incorporated by reference herein. Removal of the reservoir module 14 may be accomplished by axial slide-off separation of the ratchet nut 62 from the bolt 70, when a two-way ratchet connection is used. Alternately, reservoir removal may require rotational displacement of the bolt 70 with a wrench 74 or other tool (FIG. 6) to release the bolt threads from the ratchet nut 62.

In an alternative preferred form of the invention, as depicted in FIGS. 7 and 8, the bottled water station can be adapted to additionally include hot water dispensing capability. In this regard, components shown in FIGS. 7 and 8 which correspond structurally with those previously shown and described with respect to FIGS. 1–6 will for convenience be identified by common primed reference numerals.

As shown in FIGS. 7 and 8, a modified drop-in reservoir 14, includes a hot water fitting 76 for delivering a portion of the water from the reservoir to a hot water tank 78 mounted within the bottled water station. The structure and function of the hot water fitting 76 and tank 78 may correspond with those shown and described in prior-referenced copending U.S. Pat. Nos. 5,246,141 and 5,192,004, which are incorporated by reference herein. As shown, the hot water fitting 76 and tank 78 are adapted for slide-fit coupling when the reservoir 14' is installed into the bottled water station. Water heated within the tank 78 can then be selectively dispensed through a short conduit 80 leading from the fitting 76 to a hot water faucet 82. A suitable groove 84 may be formed in the chiller plate unit 16' to accommodate the hot water conduit 80, or the underside of the reservoir 14' may be shaped to accommodate the conduit 80. The slide-fit lock means 15' functions as previously described to retain the reservoir 14' in intimate seated contact with the chiller plate unit 16'.

A variety of further modifications and improvements to the invention will be apparent to those skilled in the art. Accordingly, no limitation on the invention is intended by way of the foregoing description and accompanying drawings, except as set forth in the appended claims.

What is claimed is:

1. A water station comprising:

a reservoir having a hollow interior for receiving and storing a supply of water;

a station housing having support means defining an upwardly open cavity for drop-in receiving and supporting said reservoir and for slide-fit removal thereof;

a chiller plate unit mounted within said station housing and defining a chilled surface for contacting said reservoir to chill water within said reservoir, when said reservoir is mounted within said station housing;

lock means for removably retaining said reservoir in seated contact with said chilled surface, said lock means comprising interengageable lock members mounted respectively on said reservoir and on said station housing and adapted for locking interengagement when said reservoir is installed into said station housing; and faucet means for dispensing water from said reservoir.

2. The water station of claim 1 wherein said lock means comprise ratchet members.

3. The water station of claim 1 wherein said lock members comprise a bolt mounted on said station housing, and an axial slide-fit nut mounted on said reservoir.

4. The water station of claim 1 wherein said reservoir is adapted to receive the supply of water from an inverted water bottle mounted on said station housing.

5. The water station of claim 1 wherein said station housing includes a front wall having at least one faucet port formed therein, and further wherein said reservoir has a front wall with at least one faucet fitting mounted thereon in a position for general alignment with said faucet port when said reservoir is mounted within said station housing, said faucet means including a faucet removably mounted through said faucet port to said faucet fitting.

6. The water station of claim 5 further including insulation means within said station housing for insulating at least a portion of said reservoir when said reservoir is mounted within said station housing.

7. A water station comprising:

a reservoir having a hollow interior for receiving and storing a supply of water;

a station housing having support means for receiving and support said reservoir;

a chiller plate unit mounted within said station housing and defining a chilled surface for contacting said reservoir to chill water within said reservoir, when said reservoir is mounted within said station housing, said chiller plate unit comprising interconnected support plates defining a hollow interior with a refrigeration chiller coil mounted therein, and a heat conductive fluid occupying the substantial residual volume of the interior of said chiller plate unit, said heat conductive fluid provided efficient heat transfer between said reservoir and said chiller coil;

lock means for removably retaining said reservoir in seated contact with said chilled surface; and faucet means for dispensing water from said reservoir.

8. The water station of claim 7 wherein said heat transfer fluid comprises a thermal mastic material.

9. The water station of claim 7 wherein said heat transfer fluid comprises a water-based fluid.

10. The water station of claim 7 wherein said reservoir is formed from a plastic material.

11. The water station of claim 10 wherein said support plates of said chiller plate unit are formed from a plastic material.

12. A water station, comprising:

a reservoir having a hollow interior for receiving and storing a supply of water;

a station housing having support means defining an upwardly open cavity for receiving and supporting said reservoir in a manner permitting slide-in installation and slide-out removal of said reservoir;

said housing cavity being defined by a bottom wall and side walls lined with an insulation material, and further including a chiller plate unit defining a chilled heat transfer surface disposed within said housing cavity for contacting said reservoir when said reservoir is mounted therein;

lock means for removably retaining said reservoir in intimate seated contact with said chilled heat transfer surface when said reservoir is mounted within said housing cavity, said lock means comprising interengageable lock members mounted respectively on said reservoir and on said station housing and adapted for locking interengagement when said reservoir is installed into said station housing;

said reservoir having at least one faucet fitting mounted thereon in a position for general alignment with a corresponding faucet port formed in said insulation material and said housing, when said reservoir is mounted within said station housing; and a faucet removably mounted on said reservoir by extension through said faucet port, said faucet being operable to dispense water from said reservoir.

13. The water station of claim 12 wherein said chiller plate unit extends generally horizontally across the bottom of said housing cavity.

14. The water station of claim 12 wherein said lock means comprise ratchet members.

15. The water station of claim 12 wherein said lock members comprise a bolt mounted on said station housing, and an axial slide-fit nut mounted on said reservoir.

16. A water station, comprising:

a reservoir having a hollow interior for receiving and storing a supply of water;

a station housing having support means defining an upwardly open cavity for receiving and supporting said reservoir in a manner permitting slide-in installation and slide-out removal of said reservoir;

said housing cavity being defined by a bottom wall and side walls lined with an insulation material, and further including a chiller plate unit defining a chilled heat transfer surface disposed within said housing cavity for contacting said reservoir when said reservoir is mounted therein;

said chilled plate unit comprising interconnected support plates defining a hollow interior with a refrigeration chiller coil mounted therein, and a heat conductive fluid occupying the substantial residual volume of the interior of said chiller plate unit, said heat conductive fluid providing efficient heat transfer between said reservoir and said chiller coil;

lock means for removably retaining said reservoir in intimate seated contact with said chilled heat transfer surface when said reservoir is mounted within said housing cavity;

said reservoir having at least one faucet fitting mounted thereon in a position for general alignment with a corresponding faucet port formed in said insulation material and said housing, when said reservoir is mounted within said station housing; and a faucet removably mounted on said reservoir by extension through said faucet port, said faucet being operable to dispense water from said reservoir.

17. The water station of claim 16 wherein said heat transfer fluid comprises a thermal mastic material.

18. The water station of claim 17 wherein said heat transfer fluid comprises a water-based fluid.

19. The water station of claim 17 wherein said reservoir and said support plates of said chiller plate unit are formed from a plastic material.

20. A water station, comprising:

a reservoir having a hollow interior for receiving and supporting a supply of water;

a station housing having support means defining an upwardly open cavity for slide-in reception and slide-out removal of said reservoir, said cavity being defined by a bottom wall comprising a chiller plate unit with a chilled heat transfer surface, and upstanding side walls of an insulation material to surround a lower portion of said reservoir when said reservoir is installed into said housing;

lock means including interengageable lock members mounted on said bottom wall and said reservoir for engagement upon installation of said reservoir into said housing to retain a bottom wall of said reservoir in intimate heat transfer relation with said chilled heat transfer surface;

a baffle plate dividing the interior of said reservoir into upper and lower chambers;

a pair of faucet fittings on said reservoir is respective flow communication with said upper and lower chambers;

said housing and said insulation material having faucet ports formed therein in general alignment with said faucet fittings when said reservoir is installed into said housing; and a pair of faucets removably mounted to said faucet fittings, to extend through said faucet ports, said faucets being respectively operable to dispense water from said upper and lower chambers.

21. The water station of claim 20, further including a hot water tank within said station housing, and fitting means on said housing and said reservoir for interconnecting said reservoir with said hot water tank when said reservoir is installed into said housing.

* * * * *